US006545662B1

(12) United States Patent
Noll et al.

(10) Patent No.: US 6,545,662 B1
(45) Date of Patent: Apr. 8, 2003

(54) OPERATING DEVICE HAVING AN ACTUATOR WITH AT LEAST TWO ADJUSTMENT DEGREES OF FREEDOM

(75) Inventors: Heinrich Noll, Gross-Umstadt (DE); Herbert Breinich, Wiesbaden (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/405,273

(22) Filed: Sep. 23, 1999

(30) Foreign Application Priority Data

Sep. 24, 1998 (DE) ..... 198 43 854

(51) Int. Cl.[7] ..... G09G 5/08
(52) U.S. Cl. ..... 345/158; 345/165
(58) Field of Search ..... 345/156, 158, 345/161, 164, 166, 165, 175, 184, 157; 210/54; 273/48; 74/471

(56) References Cited

U.S. PATENT DOCUMENTS 4,533,827 A 8/1985 Fincher ..... 250/211
4,731,530 A 3/1988 Mikan ..... 250/211
5,097,415 A * 3/1992 Yoshimura et al. ..... 345/177
5,484,967 A * 1/1996 Yanagisawa et al. ..... 345/177
5,491,305 A * 2/1996 Kawakami et al. ..... 345/177
5,847,694 A * 12/1998 Redford et al. ..... 345/158
5,911,626 A * 6/1999 McCrea, Jr. ..... 273/292
6,033,309 A * 3/2000 Couch et al. ..... 273/148 B
6,078,312 A * 6/2000 Liebenow ..... 345/161
6,121,955 A * 9/2000 Liu ..... 345/161
6,222,179 B1 * 4/2001 Mikan ..... 250/221
6,334,049 B1 * 12/2001 Nishiyama et al. .... 379/433.04

FOREIGN PATENT DOCUMENTS

DE 2354295 5/1974

OTHER PUBLICATIONS

Electro–Optical Cursor Controller in Tech. Dis. Bull., vol. 27 No. 11, Apr. 1985 p. 6537–6539.

* cited by examiner

*Primary Examiner*—Vijay Shankar
*Assistant Examiner*—Nitin Patel
(74) *Attorney, Agent, or Firm*—Martin A. Farber

(57) ABSTRACT

In an operating device having an actuator (1) with at least two adjustment degrees of freedom, provision is made for said device to have a device (3, 5, 6) for evaluating the position of the actuator (1) optically.

8 Claims, 3 Drawing Sheets

OPERATING DEVICE HAVING AN ACTUATOR WITH AT LEAST TWO ADJUSTMENT DEGREES OF FREEDOM

FIELD AND BACKGROUND OF THE INVENTION

The invention relates to a operating device having an actuator, in particular for input into electronic devices, with at least two adjustment degrees of freedom. So-called joysticks are known from the prior art, and have an actuator which has at least two adjustment degrees of freedom at right angles to each other. Known joysticks have electromechanical switches and/or potentiometers, which are operated or changed by the actuator and thus change electrical values, which are then evaluated and thus control the electronic device. The disadvantage with the electromechanical switches and potentiometers is that a large number of cables or electrical lines are needed for the evaluation, and these have to be laid expensively and protected against damage.

The object of the invention is therefore to specify an operating device having an actuator with at least two adjustment degrees of freedom in which it is possible to dispense with the laying of a large number of cables or other lines in order to evaluate the position of the actuator.

SUMMARY OF THE INVENTION

According to the invention, this object is achieved by the operating device having a device for evaluating the position of the actuator optically. It is thus not necessary for any electrical information to be conducted between the actuator and evaluation unit. The medium for transporting the light beams can comprise, for example, air and/or a solid material which conducts light. By this means, the electromagnetic compatibility of the operating device is also increased.

An evaluation of this type may be implemented particularly simply if the actuator can be used to operate an apparatus for changing the light beam optically, and the operating device has a sensor for evaluating the optical changes in the light beam. This change can be implemented by this apparatus for changing a light beam optically changing the intensity and/or spectral components of the light beam. This change can take place as a result of reflection or absorption. Thus, for example, a light beam can be reflected at a variously configured disk or a variously configured section of a sphere. For instance, the disk or the section of a sphere may have different colors, for example may be coated with different colors, and the position and color of the disk or of the section of the sphere from which the light beam is reflected may depend on the position of the actuator. Thus, for example in the case of a red component of a disk or of a section of a sphere, the red component of the light beam is reflected particularly strongly, while the other spectral components are more suppressed.

Instead of reflection, absorption is also possible. Thus, for example, a light beam can be transmitted through a variously colored, translucent disk or a corresponding section of a sphere, the color through which the beam is transmitted depending on the position of the actuator. The construction becomes particularly simple if a sensor is integrated in a transmitter/receiver component which transmits a pulsed light beam, which includes the three primary colors red, green, blue, for example serially, toward a reflecting disk or a reflecting section of a sphere, and evaluates the reflected light beam in the sensor. Such a transmitter/receiver component can be mounted on a printed circuit board with little outlay, If the reflecting disk or the reflecting section of a sphere is arranged closely above the transmitter/receiver component with the sensor, no additional optical component is needed. A light conductor between the transmitter/receiver component and the reflecting component improves the functional reliability if these two components are arranged remote from each other. This makes it possible, for example, to integrate the actuator in a further operating element, for example a rotary switch or a rotary positioner, without great outlay on design, since only one light conductor is needed for information transfer, and no dedicated power supply is needed on the actuator.

BRIEF DESCRIPTION OF THE DRAWINGS

The invention will be explained in more detail below for particularly preferred exemplary embodiments, using the figures of the drawings, in which.

DETAILED DESCRIPTION OF THE PREFERRED EMBODIMENTS

Figure 1:
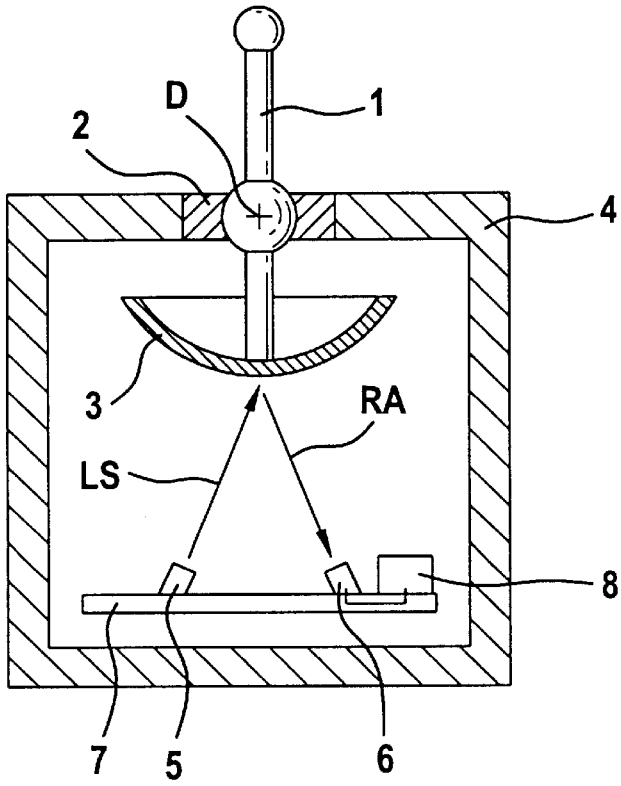
FIG. 1 shows a partial section through an operating device which has an actuator with a spherical section and a number of adjustment degrees of freedom, a separate light transmitter and a sensor.

FIG. 1 shows an actuator 1, which is mounted in a bearing 2 and at its lower end has a multicolored section of a sphere 3. The bearing 2 is firmly connected to a housing 4. A light transmitter 5 and a sensor 6 are mounted on a printed circuit board 7 in such a way that the light transmitter 5 emits a light beam LS toward the section of the sphere 3, and the reflected light beam RA is received by the sensor 6. The actuator 1 can be moved in every direction until the section of the sphere 3 strikes the housing 4, or the actuator 1 strikes a stop (not illustrated). All the points on the reflected surface of the section of the sphere 3 are at the same distance from the pivot point D of the actuator 1. Depending on the position of the actuator 1, the reflected light beam RA has a different brightness and/or spectral components, so that the position of the actuator can be determined, in an evaluation and control unit B, from the information supplied by the sensor 6.

Figure 2:
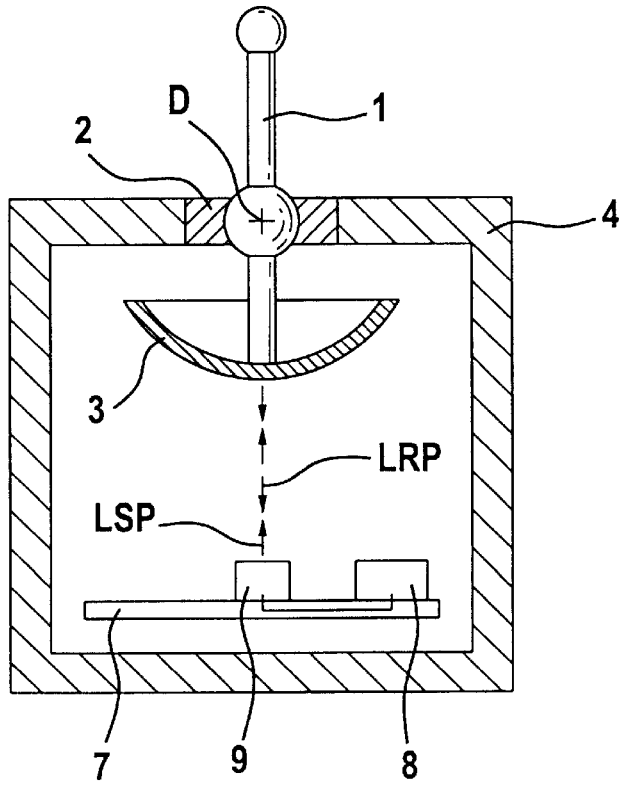
FIG. 2 shows a section through an operating device which has an actuator with a spherical section and a number of adjustment degrees of freedom, and a transmitter/receiver component.

The construction of the operating device in FIG. 2 differs from that described in FIG. 1 primarily in the fact that the light transmitter and the sensor are integrated in a transmitter/receiver component 9. The transmitter/receiver component 9 transmits pulsed light beams LSP toward the section of the sphere 3 and, depending on the position of the actuator 1, receives differently colored reflected light beams LRP. The information supplied by the sensor can then again be evaluated in the evaluation and control unit 8.

Figure 3:
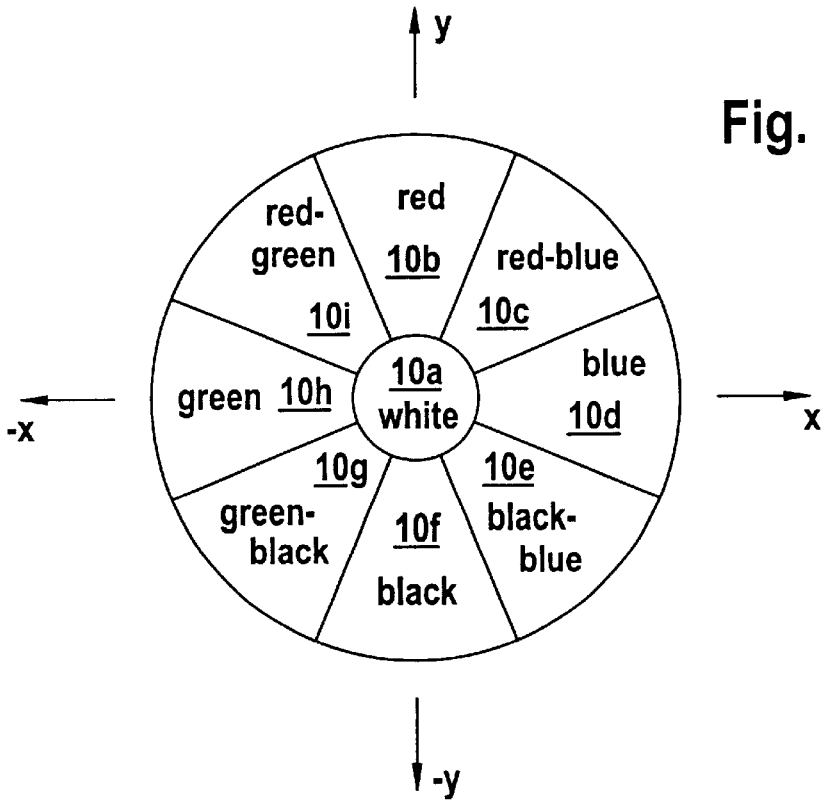
FIG. 3 shows an example of the colored configuration of the section of a sphere or of the disk which reflect the light beams.

FIG. 3 illustrates one possible configuration of the surface of the section of the sphere 3 or of a disk. Illustrated at the center is a round sector 10*a*, around which eight sectors 10*b*–10*i* shaped line pieces of pie are arranged. The sectors have the following colors:

10*b*: red,

10*c*: reddish blue,

10*d*: blue,

10*e*: blackish blue,

10*f*: black,

10*g*: greenish black,

10*h*: green,

10*i*; reddish green.

Thus, depending on the position of the actuator 1, a different color spectrum is reflected. The position of the actuator 1 can then be detected from this color spectrum. Even better resolution of the position can be implemented if the adjacent colors do not have rigid boundaries but merge into one another and/or the intensity of the individual colors/color mixtures increases from the center toward the outer edge.

Figure 4:
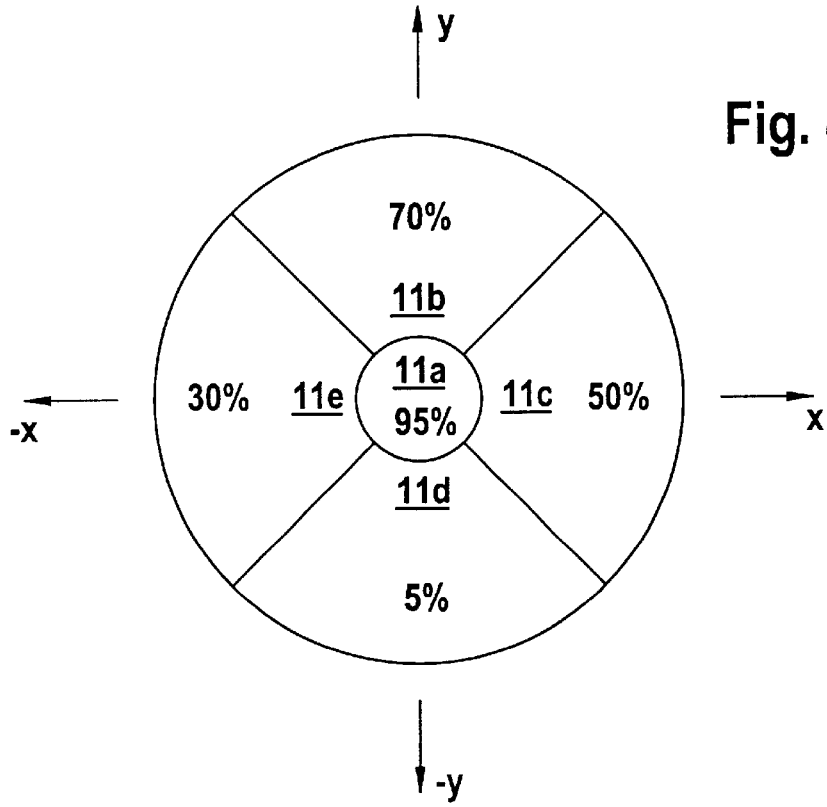
FIG. 4 shows a plan view of another example of the colored configuration of the section of a sphere or of the disk which reflect the light beams and, FIG. 5 shows a section through another operating device according to the invention which, in addition to the actuator, comprises a rotary positioner with haptic feedback and an indicator.

In FIG. 4, a disk 11 has a round sector 11*a* at the center, around which 4 sectors 11*b*–11*e* are grouped. The individual sectors 11*a*–11*e* all have different gray stages, so that different brightnesses are measured by the light sensor 6, depending on the position of the actuator 1 in the x, y, −x, −y direction or 0 position, and thus the position of the actuator 1 can be detected.

Instead of a colored configuration of the surface of the disk 11 or of the section of the sphere 3, it is possible, for example, to apply codes to their surfaces, for example bar codes, and then to read these, depending on the position of the actuator, and thus to determine the position of the actuator 1.

Figure 5:
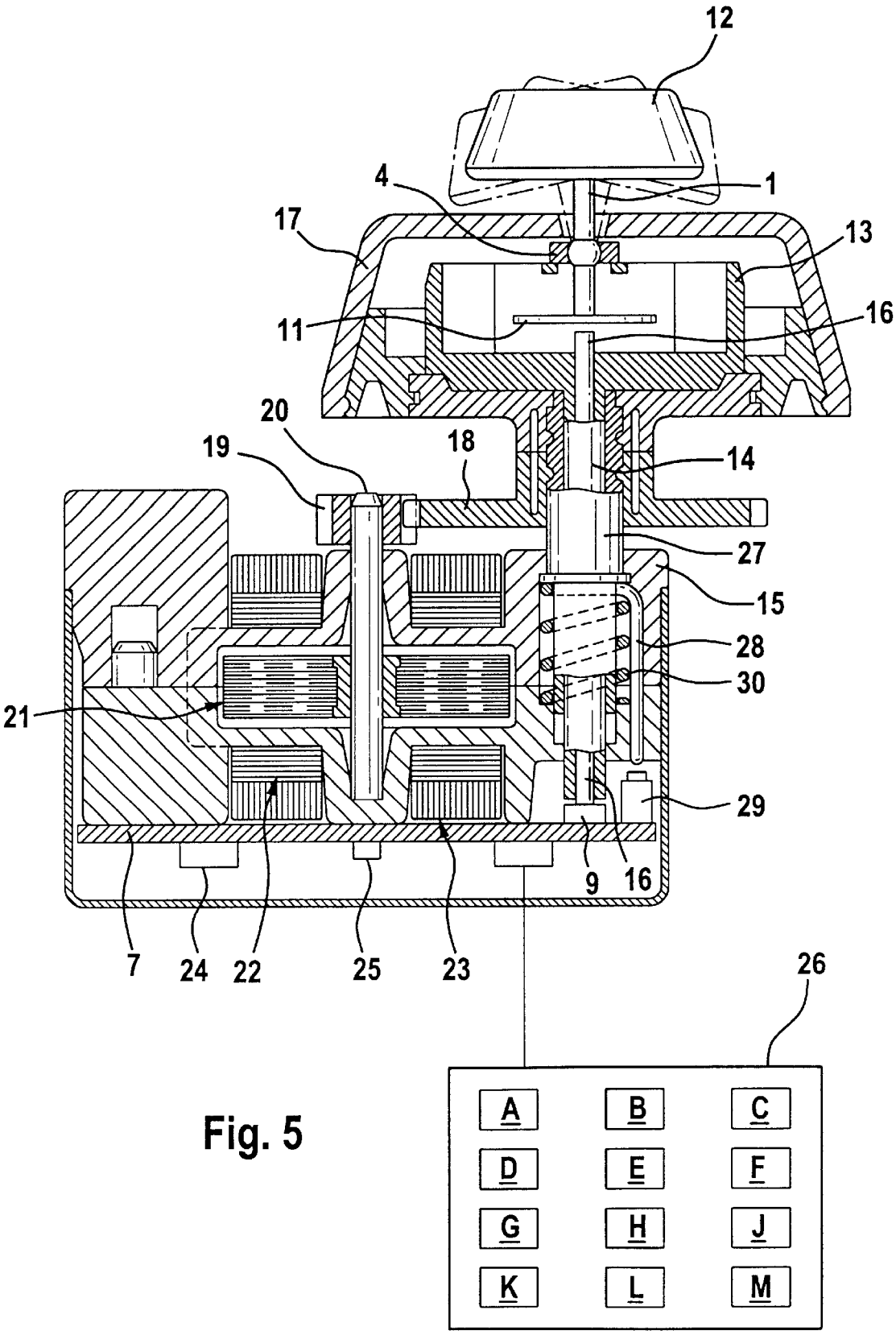

In FIG. 5, the actuator 1 has the form of an operating rocker. Fitted to the underside of the actuator 1 is a disk 11, whose underside is coated, for example as in FIGS. 3 or 4. The bearing 4 of the actuator 1 is connected, via a housing 13, and a rigid axle 14, to a rotary positioner housing 15. Arranged in the rigid axle 14 is a light conductor 16, which extends at a small distance from the underside of the disk 11 as far as the transmitter/receiver component 9, which is arranged on the printed circuit board 7. The transmitter/receiver component 9 transmits pulsed light beams through the light conductor 16 onto the underside of the disk 3 and, as described above for FIG. 2, evaluates the light beams reflected from the disk 3 and can thus determine the position of the actuator 1. Furthermore, the operating device in FIG. 5 has a rotary positioner handle 17, which is firmly connected to a gearwheel 18 and is mounted so that it can rotate about the rigid axle 14. The gearwheel 18 drives a diametrically magnetized round magnet 21 via a pinion 19 and a shaft 20. A force can be exerted on the round magnet 21 by coils 22, 23 through which current flows, which enclose the rotary positioner housing 15 and make a right angle with each other. The position of the round magnet 21 can be determined by Hall sensors 24, 25.

The operating device is connected to an indicator 26 of an electronic device (otherwise not illustrated). Functional groups, functions A–M and/or function values, which can be dialed and/or selected by the operating device, can be displayed on the indicator 26.

Depending on the position of the round magnet 21, any desired torque curve can be produced, as a function of the position of the actuator 1 and/or of the functional groups, functions or function values to be selected with the operating device, by appropriately applying current to the coils 22, 23 on the rotary positioner handle 17. Furthermore, the rotation of the round magnet 21 produces a signal with which a function or a function value is switched over to the next function or the next function value. Selecting the functional group, function or the function value can be carried out either by means of a pressure vertically from above on the rotary positioner handle 17 via an actuating shaft 27 and a sensing arm 28 on a sensor 29, counter to the force of a compression spring 30, and can thus select a functional group, one of the functions A–M or a function value, to which a change was made. It is also possible to execute the functional group, the function or the function value by tilting the actuator 1 in a specific or any desired way.

It is thus possible for the operator, as a result of the different torque curves on the rotary positioner, to feel the function or functional group in which he is currently located, or which function value he is currently setting.

The last-described exemplary embodiment makes it clear that, using the operating device according to the invention, even complex operating devices can be implemented, without any expensive outlay on cabling being necessary for the actuator.

The invention permits many configurations. Thus, for example, it is also possible to provide two light conductors with a separate light transmitter and sensor instead of one pulsed-light source with one light conductor.

If a white reflective surface is used in the segments 10*a*, 11*a*, it is additionally possible to calibrate the automatic sensor system continuously or at time intervals, in order to compensate for aging phenomena and possible soiling.

We claim:

1. An operating device comprising: an actuator (1) movable around a pivot point with at least two adjustment degrees of freedom, an evaluation device (3, 5, 6, 9, 11) for evaluating a position of the actuator (1) optically, an apparatus for changing a light beam optically, and an optical sensor;

wherein the evaluation device comprises the apparatus for changing the light beam, and the evaluation device evaluates a multiplicity of positions;

wherein the actuator (1) operates the apparatus (3, 11) for changing the light beam (LS, LSP) optically, the optical change in the light beam (LR, LRP) is detected by the optical sensor (6, 9); and the apparatus (3, 11) for changing the light beam optically is constructed as a variously colored single disk (11) or a variously colored section of a single sphere (3), said colored disk and said colored spherical section each having the multiplicity of positions which are variously colored.

2. The operating device as claimed in claim 1, wherein the apparatus (3, 11) for changing a light beam optically changes the intensity and/or spectral components of the light beam (LS, LSP, LR, LRP).

3. The operating device as claimed in claim 2, wherein the apparatus (3, 11) for changing the light beam (LS, LSP) optically reflects components of the light beam.

4. The operating device as claimed in claim 1, further comprising a light transmitter which transmits pulsed light beams (LSP) to the variously colored disk (11) or the variously colored section of a sphere (3), and the reflected light beams (LSP) are received in the sensor.

5. The operating device as claimed in claim 1, wherein one or more light conductors (16) are arranged between the light transmitter (5) and the section of the sphere (3) or the disk (11) and/or between the disk (11) or the section of the sphere (3) and the sensor (6).

6. The operating device as claimed in claim 5, wherein the actuator (1) is arranged in a rotary switch or a rotary positioner handle (17).

7. The operating device as claimed in claim 6, wherein the rotary switch or rotary positioner handle (17) is rotable about a rigid axle (14) and a light conductor (16) is arranged in the rigid axle (14).

8. The operating device as claimed in claim 5, further comprising a printed circuit board, and wherein the sensor (6) is positioned on the printed circuit board (9).

* * * * *